US006227370B1

(12) United States Patent
Earnshaw et al.

(10) Patent No.: US 6,227,370 B1
(45) Date of Patent: May 8, 2001

(54) TIERED PACK

(75) Inventors: Nigel William Earnshaw, Huddersfield; Michael Hartley, Upper Haugh, both of (GB)

(73) Assignee: Linpac Containers Limited (GB)

( * ) Notice: Subject to any disclaimer, the term of this patent is extended or adjusted under 35 U.S.C. 154(b) by 0 days.

(21) Appl. No.: 09/359,568

(22) Filed: Jul. 22, 1999

(30) Foreign Application Priority Data

Jul. 29, 1998 (GB) ..... 9816388

(51) Int. Cl.[7] ..... B65D 65/00

(52) U.S. Cl. ..... 206/497; 206/509; 229/120.33; 229/120.36

(58) Field of Search ..... 206/597, 600, 206/509, 497, 499; 229/915, 120.36, 120.33; 217/30, 31

(56) References Cited

U.S. PATENT DOCUMENTS

| | | | | |
|---|---|---|---|---|
| 2,077,588 | * | 4/1937 | Schaefer | 229/120.1 |
| 2,633,285 | * | 3/1953 | Kells | 229/120.05 |
| 2,643,810 | * | 6/1953 | Fleming | 229/120.36 |
| 2,690,285 | * | 9/1954 | Main | 206/509 |
| 2,736,483 | * | 2/1956 | Moore | 229/120.1 |
| 2,749,011 | * | 6/1956 | Lebow | 229/120.1 |
| 3,486,680 | * | 12/1969 | Negus, Jr. | 229/120.1 |
| 4,046,256 | * | 9/1977 | Congleton | 206/497 |
| 5,011,013 | * | 4/1991 | Meisner et al. | 206/373 |
| 5,040,681 | * | 8/1991 | Grusin | 206/503 |
| 5,050,738 | * | 9/1991 | McAdams | 206/497 |
| 5,316,207 | | 5/1994 | Ross et al. . | |
| 5,339,957 | * | 8/1994 | Carstens | 206/499 |
| 5,361,975 | | 11/1994 | Droste et al. . | |
| 5,415,344 | | 5/1995 | Harrelson . | |
| 5,669,498 | * | 9/1997 | Fierek et al. | 206/373 |

* cited by examiner

*Primary Examiner*—Paul T. Sewell
*Assistant Examiner*—Shian Luong
(74) *Attorney, Agent, or Firm*—Domenica N. S. Hartman; Gary M. Hartman

(57) ABSTRACT

A tiered pack comprising a plurality of tiers 10, 10', 10" each comprising a generally planar base 1 and a plurality of compartment defining dividers 21 supported thereon, wherein one or more dividers 21 of at least one of the tiers and the base 1 of an adjacent tier include respective complementary engaging means 16, 24 for enhancing the stability and rigidity of the pack. The pack may be placed on a conventional pallet and shrink-wrapped once each compartment has been filled with goods thereby forming a transit package.

18 Claims, 4 Drawing Sheets

TIERED PACK

CROSS REFERENCE TO RELATED APPLICATIONS

This U.S. patent application claims the benefit and priority of British patent application No. 9816388.4, filed Jul. 29, 1998.

BACKGROUND OF THE INVENTION

1. Field of the Invention

This invention relates to a tiered pack for use with a pallet and/or palletised or unpalletised containers. When used with a pallet, the tiered pack may be shrink-wrapped thereon.

2. Description of the Prior Art

Tiered packs for use in transit packages are known, an example of which is disclosed in U.S. Pat. No. 3,690,285 to Main.

BRIEF SUMMARY OF THE INVENTION

In accordance with a first aspect of the invention, there is provided a tiered pack comprising a plurality of tiers each comprising a generally planar base and a plurality of compartment defining dividers supported thereon, wherein one or more dividers of at least one of the tiers and the base of an adjacent tier include respective complementary engaging means for enhancing the stability and rigidity of the pack.

In accordance with a second aspect of the invention, there is provided a tier for use in a tiered pack, which tier comprises a generally planar base upon which is supported a plurality of compartment-defining dividers, wherein at least one of the dividers comprises means engaging or arranged to engage complementary means associated with the base of another such tier stacked thereupon.

In accordance with a third aspect of the invention, there is provided a tier for use in a tiered pack, which tier comprises a plurality of compartment-defining dividers upon which is supported a generally planar base, wherein at least one of the dividers comprises means engaging or arranged to engage complementary means associated with the base.

Preferably that part of the complementary engaging means associated with the at least one divider, is arranged at or adjacent the top edge thereof and, in the embodiment to be described hereinbelow, takes the form of at least one tab upwardly therefrom. More preferably, a plurality of such tabs is provided on respective upper edges of two or more spaced, parallel dividers.

Such engaging means, and particularly when in the form of one or more tabs projecting upwardly from the upper edge(s) of at least one divider, is arranged to engage a correspondingly-shaped aperture, such as a slot or slit, in the base of the next, upper tier, in which case, the base of the lower tier is also provided with its corresponding part of complementary engaging means for engagement by the corresponding part associated with one or more of the dividers of a tier beneath the lower tier.

The invention also provides a transit package comprising a product-filled, tiered pack in accordance with the first aspect of the invention defined above, mounted upon a pallet and preferably shrink-wrapped thereto. Additionally or alternatively, the invention provides a transit package comprising a product-filled tiered pack in accordance with the first aspect of the invention defined above, when accommodated within an outer transit container.

The inventive tiered pack may also be used for product storage and/or display purposes and when used in respect of the latter, each successive upper tier may be removed, once displayed products have been removed from their respective compartments defined by the associated dividers.

Other objects and advantages of this invention will be better appreciated from the following detailed description.

BRIEF DESCRIPTION OF THE DRAWINGS

In order that the invention may be more fully understood, an embodiment of tiered pack in accordance with the first aspect of the invention, as well as an embodiment of a tier in accordance with the second aspect of the invention, will now be described by way of example and with reference to the accompanying drawings in which.

DETAILED DESCRIPTION OF THE INVENTION

Figure 1:
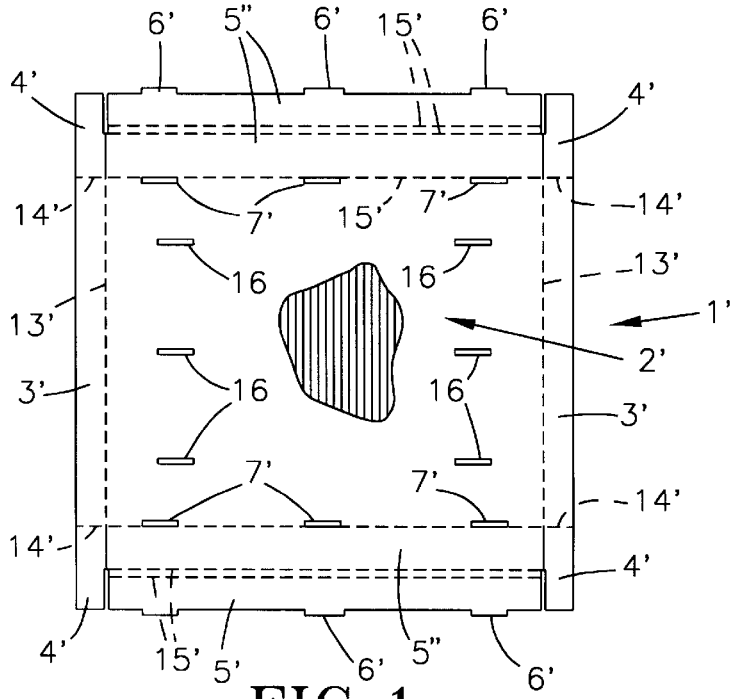
FIG. 1 is a plan view of a blank from which the base of a tier can be erected.

Referring firstly to FIG. 1 of the accompanying drawings, a blank, indicated generally at 1', is cut and creased from a sheet of corrugated board, to define a base panel 2', a first pair of opposed side wall panels 3' with tuck-in end flaps 4' and a second pair of double side wall panels 5', 5".

On erection of the blank 1' into the tray-shaped base 1 shown in FIGS. 4A to 4D, the respective pairs of side walls 3' and 5', 5", are folded about respective creases 13' and 15', with the flaps 4' being folded about corresponding creases 14'. Also, the second side wall panels 5' are folded about the respective pairs of parallel creases 15', to form respective double-thickness end walls 5 of the tray-shaped base 1, with edge tabs 6' engaging in correspondingly-shaped slots 7' spaced along the creases 15'.

Figure 4A:
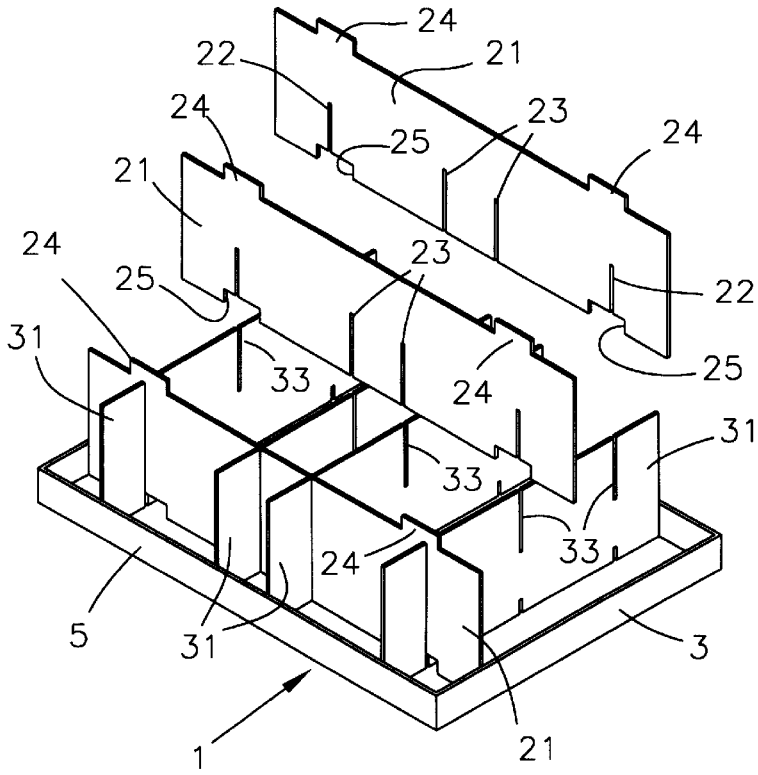
FIGS. 4A to 4D are respective perspective views of various stages of erection and assembly of a tier and a tiered pack assembled from a plurality of such tiers.
Figure 4B:
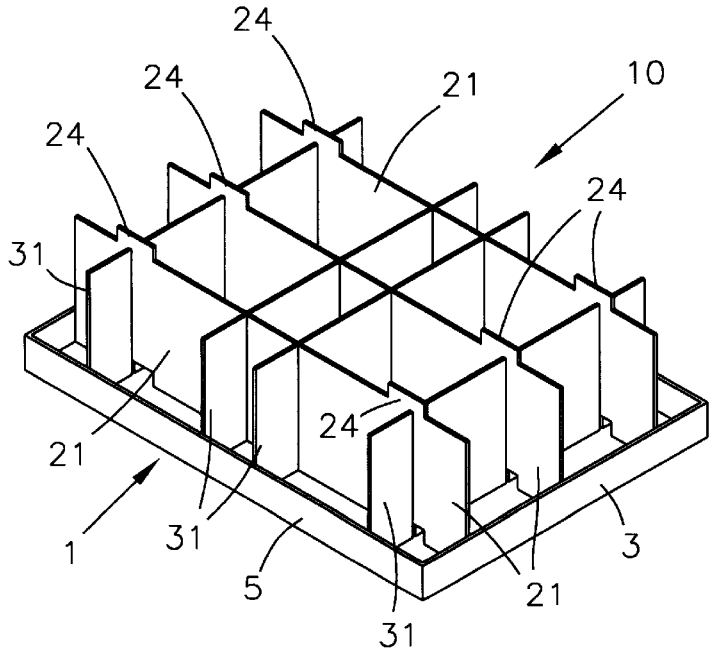

In this conventional manner, the tray-shaped base 1 of one tier, as shown generally at 10 in FIG. 4B, of a tiered pack in accordance with the invention, is formed.

Figure 2:
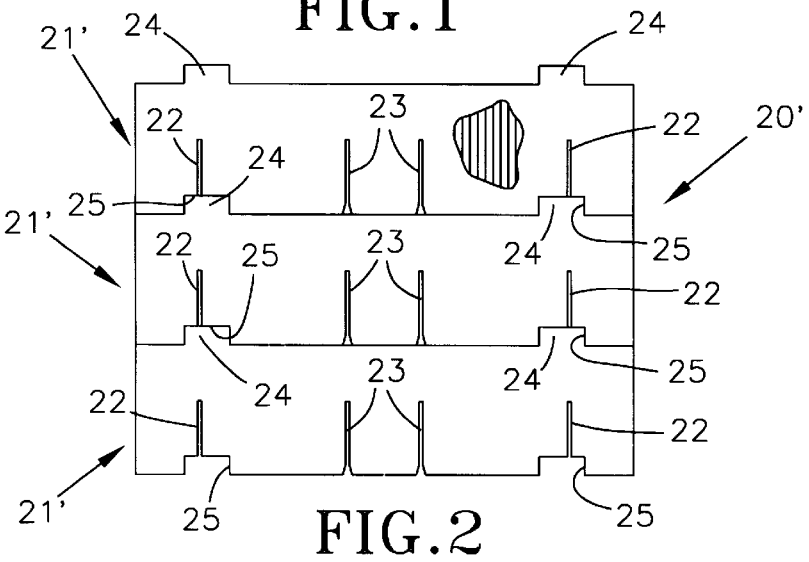
FIGS. 2 and 3 are plan views of respective blanks from which dividers of the tier can be erected.

The blank shown generally at 20' in FIG. 2 is also cut and creased from a sheet of corrugated board, to provide three divider panels 21' each provided with an outer pair of locating slots 22 and an inner pair of locating slots 23. Each of the three divider panels 21' also comprises a pair of tabs 24 spaced along the upper edge thereof and located above respective ones of the pair of outer slots 22.

When the three divider panels 21' are separated for use, the upper edge tabs 24 leave, on the lower edge of the adjacent divider panel 21', a correspondingly-shaped cut-out 25.

Figure 3:
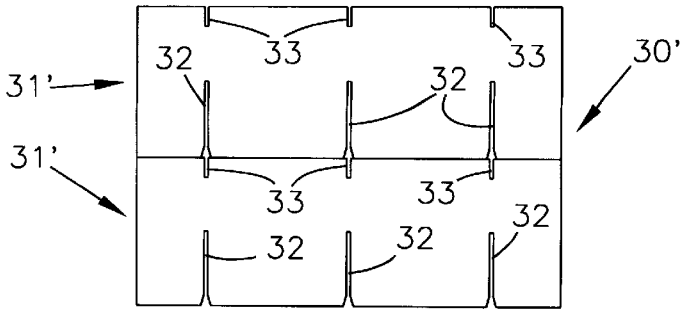

Referring now to FIG. 3 of the drawings, here there is shown a blank 30' again cut from a sheet of corrugated board, to provide a pair of divider panels 31' each having three longer slots 32 spaced along the lower edge thereof, as well as three shorter slots 33 spaced along the upper edge thereof and in longitudinal alignment with the lower edge slots 32.

In this particular embodiment, two such blanks 30' are required to provide four dividers 31, as shown in FIGS. 4A to 4D.

In known manner, the three dividers 21 provided by the three corresponding panels 21' of the blank 20' of FIG. 2 and four dividers 31 provided by the panels 31' of two blanks 30' shown in FIG. 3 are connected together in criss-cross fashion, whilst being supported upon the tier base 1, with the slots 22,23 of the three dividers 21 engaging with the corresponding slots 33 of the four dividers 31. Thus, the dividers 21,31 provide a compartmentised tier 10, as shown in FIG. 4B.

In that tier 10, the upper edge tabs 24 of each of the three dividers 21 are located above and adjacent spaced locations along the length of the two outer dividers 31.

These locations correspond with slits 16 provided in the base panel 2' of the blank 1', as shown in FIG. 1.

Figure 4C:
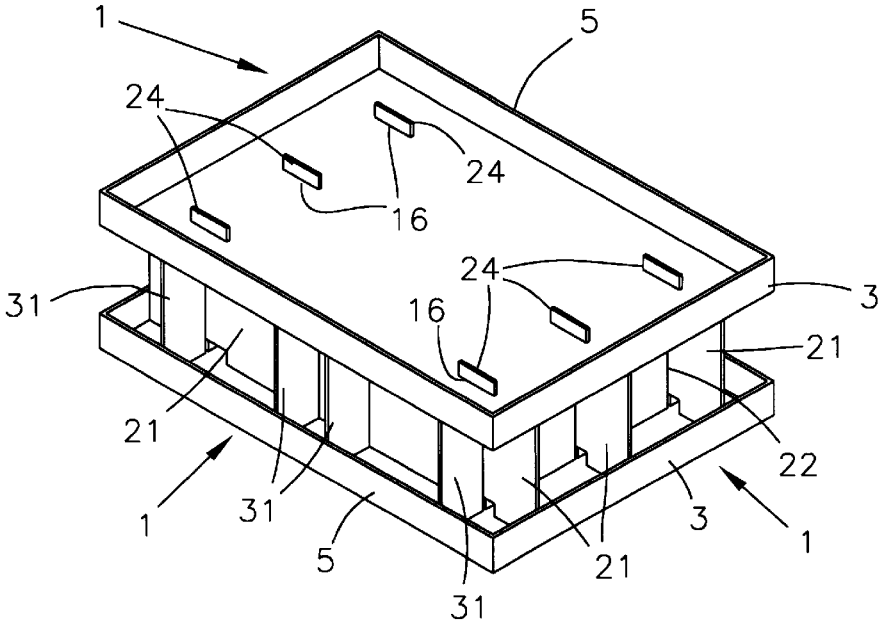
Figure 4D:
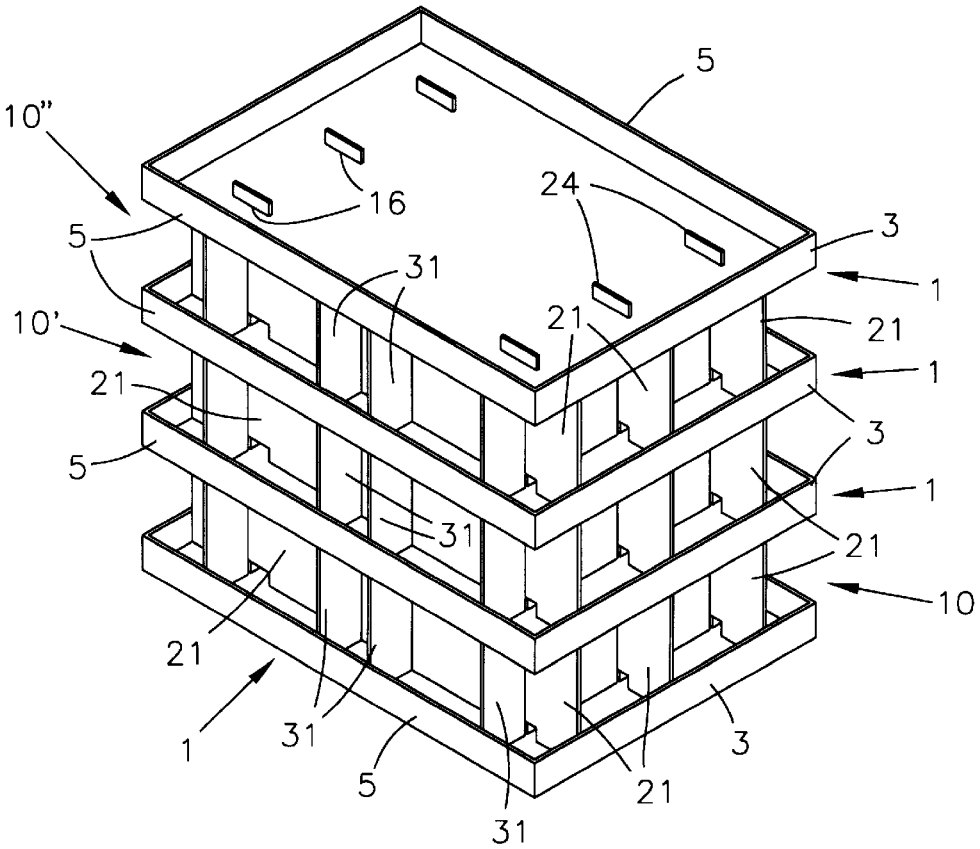

Thus, when the base 1 of the next tier 10', as shown in FIG. 4C and 4D, is applied to the previously-assembled tier 10 of FIG. 4B, the upper edge tabs 24 of the dividers 21 of the lower tier 10 are received in respective slots 16, such that the underside of the base 1 of the upper tier 10' rests upon the upper edges of the dividers 21,31, with the engaging complementary tabs 24 and slots 16 enhancing the stability and rigidity of the partially and eventually-fully erected tiered pack.

To the base 1 of the next, upper tier 10' of FIG. 4c is then applied another assembly of criss-cross dividers 21,31 which are supported upon the top side of the base 1 of the upper tier. Further tiers 10", as shown in FIG. 4D, can then be added successively, to provide a tiered, compartmentised pack.

The cut-outs 25 of each divider 21 and the shorter slots 33 of each divider 31 of one tier extend over and/or engage the corresponding tabs 24 of the dividers 21 of the tier beneath.

It is to be appreciated that any products to be accommodated within the tiered pack are accommodated within their respective compartments of each tier 10, 10', 10" as successive tiers are assembled together.

Figure 5:
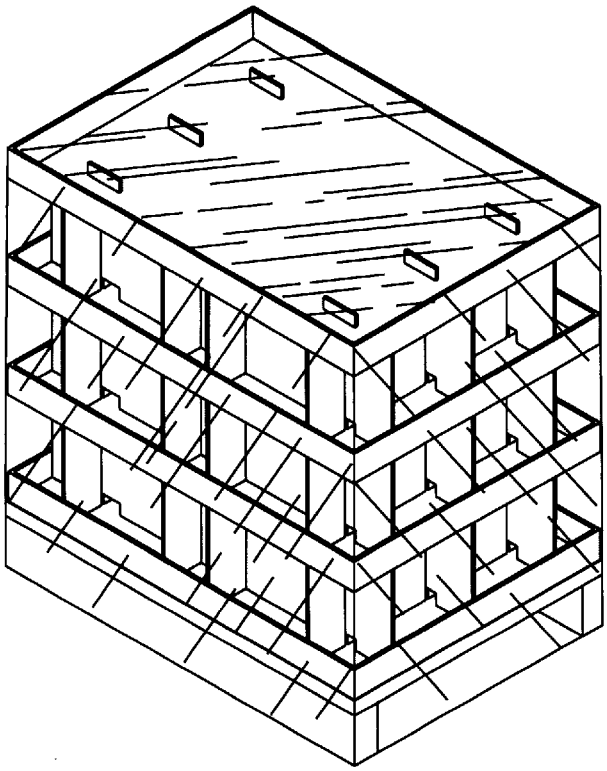
FIGS. 5 and 6 show the tiered pack of FIG. 4*d* accommodated within an outer transit container and shrink-wrapped to a pallet, respectively.
Figure 6:
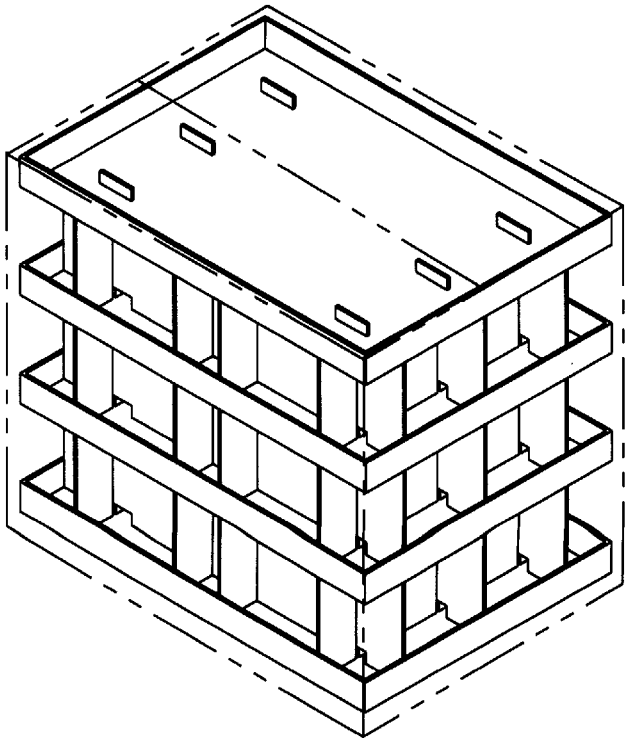

The so-assembled, tiered and compartmentised pack may be supported upon a suitably-sized pallet and then, optionally, shrink-wrapped there as shown in FIG. 5 or, alternatively, located within a transit container as shown in FIG. 6 (in which the container is shown in phantom).

When the tiered pack is used for product display purposes, products can be removed from the compartments of the uppermost tier which, when empty of products, can be removed, to provide access to products within the compartments of the next tier below.

While the invention has been described in terms of a preferred embodiment, it is apparent that other forms could be adopted by one skilled in the art. Accordingly, the scope of the invention is to be limited only by the following claims.

What is claimed is:

1. A tiered pack comprising a plurality of tiers each comprising a generally planar base and a plurality of compartment-defining dividers supported thereon, the dividers of at least one of the tiers supporting the base of an immediately adjacent tier, each of the dividers having an upper edge and an oppositely-disposed lower edge supported by the base of the at least one of the tiers, one or more of the dividers of the at least one of the tiers and the base of the adjacent tier having complementary engaging means for enhancing the stability and rigidity of the pack, the complementary engaging means of the one or more dividers being adjacent the upper edge thereof and engaged by the complementary engaging means of the base of the adjacent tier, the base of the adjacent tier being supported exclusively by the upper edges of the dividers of the at least one of the tiers.

2. A tiered pack according to claim 1, wherein the lower edge of each divider has a cutout therein that is sufficiently sized to accommodate a complementary engaging means of the one or more dividers engaged with the complementary engaging means of the base on which the divider is supported.

3. A tiered pack according to claim 1, wherein the complementary engaging means of the one or more dividers comprises at least one upwardly disposed tab.

4. A tiered pack according to claim 3, wherein the complementary engaging means of the one or more dividers comprises a plurality of tabs provided adjacent respective upper edges of two or more of the dividers that are parallel and spaced relative to each other.

5. A tiered pack according to claim 1, wherein the complementary engaging means of the one or more dividers is located in a correspondingly-shaped aperture in the base of the adjacent tier.

6. A tiered pack according claim 1, wherein the base of each of the tiers is provided with a complementary engaging means corresponding to the complementary engaging means of the base of the adjacent tier so as to be adapted for engagement by the complementary engagement means of the one or more of the dividers.

7. A tier for use in a tiered pack, the tier comprising a generally planar base upon which is supported a plurality of compartment-defining dividers, each of the dividers comprising an upper edge and an oppositely-disposed lower edge supported by the base of the tier, at least one of the dividers and the base having complementary engaging means for enhancing the stability and rigidity of the pack, the complementary engaging means of the at least one of the dividers being adjacent the upper edge thereof and engagable by the complementary engaging means of a second base identical to the base when the second base is placed on top of the dividers so that the second base is supported exclusively by the upper edges of the dividers.

8. A tier according to claim 7, wherein the lower edge of at least a second of the dividers has a cutout therein that is sufficiently sized to accommodate the complementary engaging means of the at least one divider.

9. A tier according to claim 7, wherein the complementary engaging means of the at least one of the dividers comprises at least one upwardly disposed tab.

10. A tier according to claim 9, wherein the complementary engaging means of the at least one of the dividers comprises a plurality of tabs provided adjacent respective upper edges of two or more of the dividers that are parallel and spaced relative to each other.

11. A tier according to claim 7, wherein the complementary engaging means of the base is an aperture.

12. A transit package comprising a tiered pack in accordance with claim 1, the tiered pack being filled with a product and mounted upon a pallet.

13. A transit package according to claim 12, wherein the transit package contains a product and is shrink-wrapped to the pallet.

14. A transit package comprising a tiered pack in accordance with claim 1, wherein the transit package is accommodated within an outer transit container.

15. A tier for use in a tiered pack, the tier comprising a plurality of compartment-defining dividers supported on a generally planar first base, each of the dividers comprising an upper edge on which is supported a generally planar second base, the second base and at least one of the dividers having complementary engaging means for enhancing the stability and rigidity of the pack, the complementary engaging means of the at least one of the dividers being adjacent the upper edge thereof, the second base being supported exclusively by the upper edges of the dividers, the complementary engaging means of the second base being engaged with the complementary engaging means of the at least one of the dividers, the lower edge of at least a second of the dividers having a cutout therein that is sufficiently sized to accommodate the complementary engaging means of the at least one divider.

16. A tier according to claim 15, wherein the complementary engaging means of the at least one of the dividers comprises at least one upwardly disposed tab.

17. A tier according to claim 16, wherein the complementary engaging means of the at least one of the dividers comprises a plurality of tabs provided adjacent upper edges of two or more of the dividers that are parallel and spaced relative to each other.

18. A tier according to claim 15, wherein the complementary engaging means of the second base is an aperture.

* * * * *